US009562743B1

(12) United States Patent
Mansfield

(10) Patent No.: US 9,562,743 B1
(45) **Date of Patent: *Feb. 7, 2017**

(54) GUN SIGHT APPARATUS

(71) Applicant: Michael Mansfield, Sarasota, FL (US)

(72) Inventor: Michael Mansfield, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/145,034

(22) Filed: May 3, 2016

Related U.S. Application Data

(63) Continuation-in-part of application No. 13/023,613, filed on Feb. 9, 2011, now Pat. No. 9,360,278.

(51) Int. Cl.

| | |
|---|---|
| ***F41G 1/01*** | (2006.01) |
| ***F41G 1/12*** | (2006.01) |
| ***F41G 1/02*** | (2006.01) |
| ***F41G 1/00*** | (2006.01) |

(52) U.S. Cl.
CPC . *F41G 1/01* (2013.01); *F41G 1/00* (2013.01); *F41G 1/02* (2013.01); *F41G 1/12* (2013.01)

(58) Field of Classification Search
CPC ..... F41G 1/01; F41G 1/02; F41G 1/00; F41G 1/12; F41G 1/056
See application file for complete search history.

(56) References Cited

U.S. PATENT DOCUMENTS 647,123 A * 4/1900 Warner ..... F41G 1/17 42/140
2,256,411 A * 9/1941 Russell ..... F41G 1/01 42/130
2,533,540 A * 12/1950 Warmack ..... D05C 15/06 112/80.04
3,744,143 A * 7/1973 Kilpatrick ..... F41G 1/01 42/144
3,777,380 A * 12/1973 Theodore ..... F41G 1/32 42/133
3,820,248 A * 6/1974 Hayward ..... F41G 1/32 42/145
4,745,698 A * 5/1988 Schwulst ..... F41G 1/02 42/131
5,013,925 A * 5/1991 Elshoud ..... F41G 3/323 250/505.1

(Continued)

FOREIGN PATENT DOCUMENTS

| | | | | |
|---|---|---|---|---|
| AT | WO 9732176 A1 * | 9/1997 | ..... | F41G 1/01 |
| DE | 2126068 A1 * | 12/1972 | ..... | F41G 1/01 |
| DE | 102013012819 A1 * | 2/2015 | ..... | F41G 1/01 |

*Primary Examiner* — Benjamin P Lee
(74) *Attorney, Agent, or Firm* — Cardle Patent Law Chtd.

(57) ABSTRACT

An aiming apparatus and associated methods for aiming a device such as a firearm are disclosed herein. In various aspects, the aiming apparatus may include a front sight configured as a post and a rear sight configured to include a notch. An image portion is formed on the front sight and a complementary image portion formed on the rear sight such that the image portion and the complementary image portion present a unitary image to a viewer of the front sight through the notch when the front sight is aligned with the rear sight, in various aspects. A mark is provided on the front sight visually indicative of the midpoint of the front sight. Note that this abstract is presented to meet requirements of the USPTO. This abstract is not intended to identify key elements of the apparatus and methods disclosed herein or to delineate the scope thereof.

9 Claims, 6 Drawing Sheets

(56) References Cited

U.S. PATENT DOCUMENTS 5,025,564 A * 6/1991 Sanders ..... F41G 1/04 33/297
5,887,352 A * 3/1999 Kim ..... F41G 1/08 42/144
6,058,616 A * 5/2000 Bubits ..... F41G 1/01 42/144
6,360,471 B1 * 3/2002 Stein ..... F41G 1/01 42/122
6,360,472 B1 * 3/2002 Lorocco ..... F41G 1/32 42/132
6,557,291 B2 * 5/2003 Hoadley ..... F41G 1/08 42/111
6,604,315 B1 * 8/2003 Smith ..... F41G 1/027 42/111
6,711,846 B1 * 3/2004 Nasef ..... F41G 1/01 42/130
6,868,615 B2 * 3/2005 Malley ..... F41G 1/38 33/297
D519,184 S * 4/2006 Malley ..... D22/109
7,069,685 B2 * 7/2006 Houde-Walter ..... F41C 27/00 42/113
7,721,479 B2 * 5/2010 Schulst ..... F41G 1/08 42/111
7,832,138 B1 * 11/2010 Price ..... F41G 1/01 42/111
8,919,027 B2 * 12/2014 Curry ..... F41G 1/00 42/133
9,322,614 B2 * 4/2016 Williams ..... F41G 1/02
2002/0066220 A1 * 6/2002 Malley ..... F41G 1/01 42/133
2003/0079396 A1 * 5/2003 Brown ..... F41G 1/345 42/133
2004/0010956 A1 * 1/2004 Bubits ..... F41G 1/345 42/144
2010/0077647 A1 * 4/2010 Kraft ..... F41G 1/01 42/144
2014/0047756 A1 * 2/2014 Grossman ..... F41G 1/01 42/148
2015/0226520 A1 * 8/2015 Williams ..... F41G 1/02 42/111

* cited by examiner

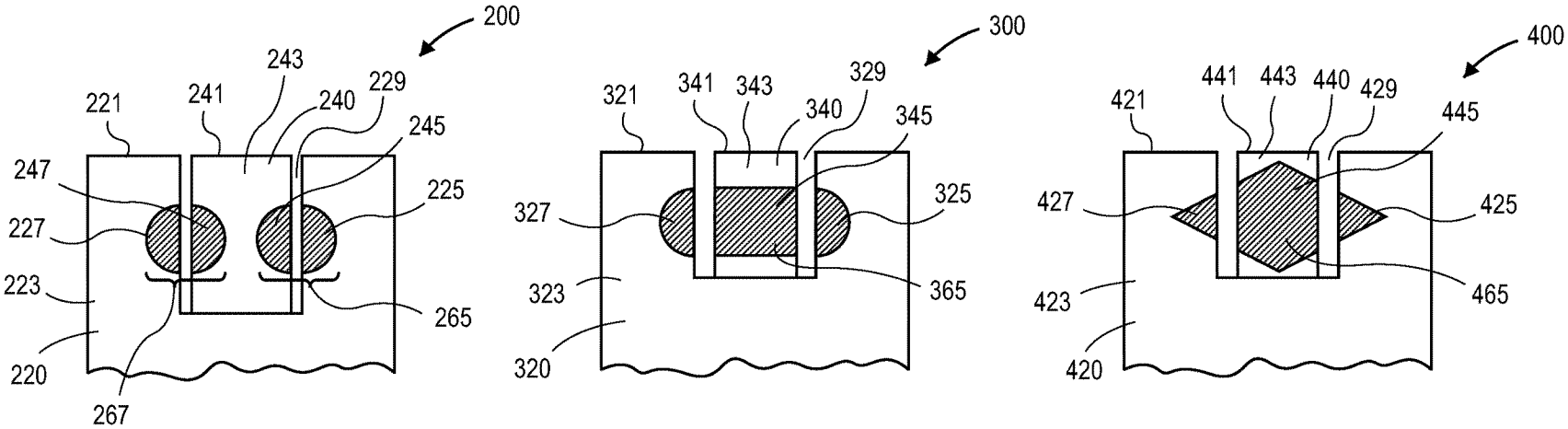
FIG. 4
FIG. 5
FIG. 6
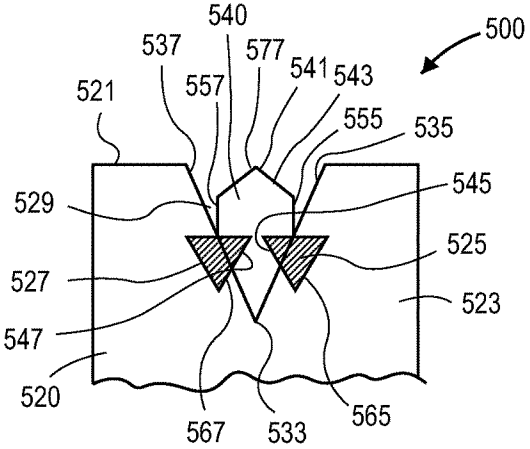
FIG. 7
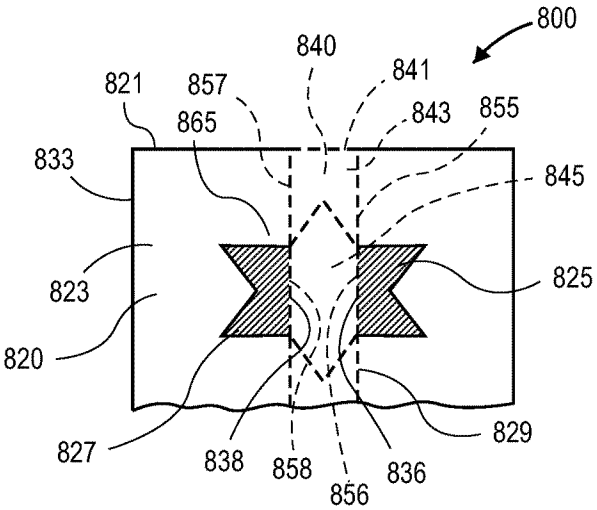
FIG. 8

GUN SIGHT APPARATUS

CROSS REFERENCE TO RELATED APPLICATIONS

This application is a Continuation-In-Part of co-pending U.S. patent application Ser. No. 13/023,613 filed 9 Feb. 2011, which is hereby incorporated in its entirety herein.

BACKGROUND

Field

The apparatus and related methods disclosed herein are generally related to aiming devices particularly aiming devices used to aim a firearm or other projectile firing device.

Description of the Related Art

A user may aim a firearm including various other devices that fire bullets including various projectiles toward a target using an aiming device in the form of a sight system. The aiming device may consist of a front sight mounted toward the front (i.e. muzzle) of the firearm and a rear sight generally mounted toward the butt of the firearm. The front sight may generally have the form of a post. The rear sight may be generally formed to have a generally flat face that extends forth from the firearm and the rear sight may include an open notch formed along a top edge (the edge of the rear sight opposite to the edge of the rear sight mounted to the firearm) of the rear sight. The user aims the firearm by viewing the front sight through the notch and manipulating the firearm until the front sight is aligned with the target within the notch of the rear sight along the line of sight. The user may then engage the target by firing the firearm at the target.

In order to strike the target with the bullet, the rear sight, front sight, and target must be properly aligned along the line of sight of the user viewing the front sight and target through the notch of the rear sight. Proper alignment of the rear sight, front sight and target may require some time. The target may be moving, which can make alignment of the rear sight, front sight, and target difficult. The target may pose a threat that may make rapid alignment of the rear sight, front sight, and target imperative. In various situations, the alignment of the rear sight, front sight and target must be accomplished under low light conditions. Rapid engagement of several targets may be required in various situations. Accordingly, there is a need for improved apparatus as well as related methods that facilitate the alignment of the rear sight, front sight, and target by the user along the user's line of sight.

BRIEF SUMMARY OF THE INVENTION

These and other needs and disadvantages may be overcome by the apparatus and methods disclosed herein. Additional improvements and advantages may be recognized by those of ordinary skill in the art upon study of the present disclosure.

An aiming apparatus is disclosed herein. In various aspects, the aiming apparatus may include a front sight configured as a post and a rear sight configured such that the front sight is viewable therethrough. An image portion is formed on the front sight, and a complementary image portion is formed on the rear sight, in various aspects. The image portion and the complementary image portion, in various aspects, form a unitary image along a line of sight passing through the rear sight when the front sight is aligned with the rear sight. A mark formed on the face of the front sight indicates a midpoint of a front sight top of the front sight when viewed along the line of sight, and the mark may be used to align the front sight with a target.

Corresponding methods of use of the aiming apparatus are disclosed herein. In various aspects, these methods may include the step of viewing a front sight comprising a post through a rear sight, and the step of aligning the front sight with the rear sight such that an image portion formed on the front sight combines with a complementary image portion formed on the rear sight thereby presenting a unitary image along a line of sight. The methods may include the step of aligning the mark with the target.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

BRIEF DESCRIPTION OF THE DRAWINGS

FIG. 4 illustrates by frontal view portions of another exemplary implementation of an aiming apparatus including the sight picture of the rear sight and front sight aligned with one another as seen along a line of sight parallel to a barrel of a firearm;

FIG. 5 illustrates by frontal view portions of another exemplary implementation of an aiming apparatus including the sight picture of the rear sight and front sight aligned with one another as seen along a line of sight parallel to a barrel of a firearm;

FIG. 6 illustrates by frontal view portions of another exemplary implementation of an aiming apparatus including the sight picture of the rear sight and front sight aligned with one another as seen along a line of sight parallel to a barrel of a firearm;

FIG. 7 illustrates by frontal view portions of another exemplary implementation of an aiming apparatus including the sight picture of the rear sight and front sight aligned with one another as seen along a line of sight parallel to a barrel of a firearm;

FIG. 8 illustrates by frontal view portions of another exemplary implementation of an aiming apparatus including the sight picture of the rear sight and front sight aligned with one another as seen along a line of sight parallel to a barrel of a firearm;

Figures 1A, 1B, 1C:
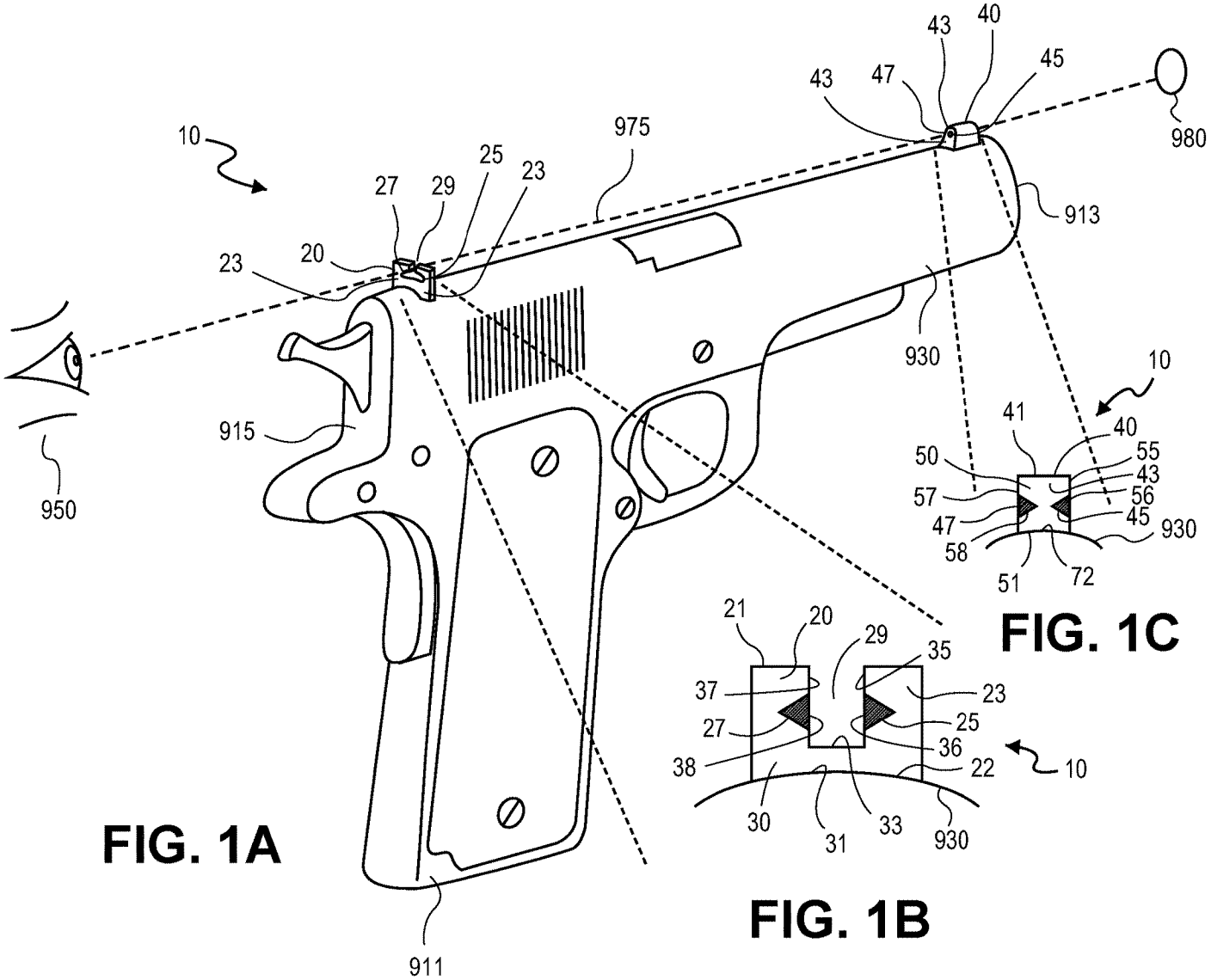
FIG. 1A illustrates by perspective view an exemplary implementation of an aiming apparatus.
FIG. 1B illustrates by frontal view portions of the exemplary implementation of the aiming apparatus of FIG. 1A including the rear sight as seen along the line of sight.
FIG. 1C illustrates by frontal view portions of the exemplary implementation of the aiming apparatus of FIG. 1A including the front sight as seen along the line of sight.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof.

DETAILED DESCRIPTION OF THE INVENTION

An aiming apparatus is disclosed herein. In various aspects, the aiming device includes a front sight generally configured as a post and a rear sight generally configured to include a notch. A user views the front sight through the notch of the rear sight. While viewing the front sight through the notch, the user may then manipulate the position of the front sight and the rear sight with respect to one another such that the front sight is aligned with the rear sight along the user's line of sight. The front sight may then be further aligned with a target so that the rear sight, front sight, and target are aligned with one another along the user's line of sight. The apparatus, in various aspects, includes an image portion formed upon the front sight and a complementary image portion formed upon the rear sight. With the front sight and rear sight in alignment with one another, the image portion formed upon the front sight and the complementary image portion formed upon the rear sight present a unitary image to the user along the user's line of sight. Methods of aiming are disclosed herein. In various aspects, the methods of aiming may include the step of viewing a front sight comprising a post through a rear sight, and may include the step of aligning the front sight with the rear sight such that an image portion formed on the front sight combines with a complementary image portion formed on the rear sight thereby presenting a unitary image to the viewer along the user's line of sight. The front sight may be viewed through a notch formed in the rear sight in some aspects, and the front sight may be viewed through portions of the rear sight formed of a transparent material in other aspects. The line of sight passes through the notch with the rear sight formed of an opaque material, in some aspects, and the line of sight passes through the transparent material of which the rear sight is formed in other aspects.

It should be recognized that, although the aiming apparatus and related methods are disclosed generally in the context of a firearm, this is for illustrative purposes only and is not intended to limit the aiming apparatus and related methods to firearms. The aiming apparatus and related methods disclosed herein may be applied in other contexts such as, for example, archery, various rocket launchers, grenade launchers, and other military weapons, the aiming of medical instruments such as medical instruments used for the taking of a biopsy, the aiming of various laser devices, the aiming of surveying instruments, lasers and other such directed energy devices, and so forth.

As illustrated in FIG. 1A, aiming apparatus 10 includes front sight 40 and rear sight 20, which are disposed on slide 930 of firearm 911. In this implementation, the front sight 40 and rear sight 20 of aiming apparatus 10 are set apart from one another, with the front sight 40 located generally proximate to the muzzle 913 of firearm 911 and rear sight located generally proximate the butt 915 of firearm 911. A user 950 may be positioned rearward of the firearm 911. The user 950 may grasp the firearm 950 using the hand(s) and, in the case of a rifle or other such elongated firearm for example, support the firearm with portions of the body including the shoulder. The firearm 911 illustrated in FIG. 1A is configured as a pistol, but the slide 930 may be a part of various other types of firearms in other implementations.

The user 950 may view target 980 along line of sight 975 that passes through notch 29 of rear sight 20, encompasses at least portions of front sight 40, and target 980. In order orient the firearm 911 with target 980 to direct a bullet from firearm 911 onto the target 980, the rear sight 20, front sight 40, and target 980 must be aligned from the viewpoint of the user 950 along the user's line of sight 975.

As illustrated in FIG. 1A, face 43 of front sight 40 is oriented toward the user 950 to be viewable by the user along the user's line of sight 975 when the user aligns the front sight 40 and the rear sight 20 with the target 980. Face 43, as illustrated, includes image portion 45 and image portion 47 (see FIGS. 1C and 2). Face 23 of rear sight 20 is oriented toward the user 950 to be viewable by the user along the user's line of sight 975 when the user aligns the front sight 40 and the rear sight 20 with the target 980. Face 23, as illustrated, includes complementary image portion 25 and complementary image portion 27 (see FIGS. 1B and 2). When front sight 40 and rear sight 20 are aligned with one another along the user's line of sight 975, image portion 45 of front sight 40 generally merges with complementary image portion 25 of rear sight 20 to form a unitary image 65 (see FIG. 2) as viewed by the user 950. Image portion 47 of front sight 40 generally merges with complementary image portion 27 of rear sight 20 to form a unitary image 67 (see FIG. 2) as viewed by the user 950, when front sight 40 are rear sight 20 are aligned with one another along the user's line of sight 975. Thus, in this implementation, in order to align front sight 40 with rear sight 20, user 950 may align image portion 45 of front sight 40 with complementary image portion 25 of rear sight 20 and image portion 47 of front sight 40 with complementary image portion 27 of rear sight 20 to form unitary images 65, 67, respectively.

The rear sight 20 of aiming apparatus 10 is illustrated in FIG. 1B. As illustrated in FIG. 1B, rear sight 20 is generally configured with face 23 having a generally planar surface with notch 29 configured therein. The notch 29, as illustrated, is an open notch that is generally rectangular with vertical sides 35, 37 meeting bottom 33 at right angles (i.e. a Patridge sight). In other implementations, notch 29 may have a "U" shape, a "V" shape, or other shape.

The rear sight base 22 may be mounted to slide 930, barrel 661 (FIG. 8), or other surface by mount 31. Rear sight 20 may be mounted proximate the user so that the user may readily look through the notch 29 of sight 20. In various implementations, mount 31 may be secured by dovetailing. In various aspects, mount 31 of rear sight 20 may include various mechanisms that allow for adjustment of rear sight 20 to compensate for windage and drop, as would be recognized by those of ordinary skill in the art upon study of this disclosure. In various implementations, face 23 of rear sight 20 may be generally vertical with respect to the surface to which the rear sight 20 is mounted or may be canted such that face 23 slopes toward muzzle 913 such that face 23 is generally closer to muzzle 913 proximate rear sight top 21 than proximate rear sight base 22.

Rear sight top 21 is the portion of face 23 generally opposite to rear sight base 22. Rear sight top 21 is generally linear and flat proximate notch 29, as illustrated. Notch 29 is formed in rear sight top 21 and notch 29 extends from rear sight top 21 toward the rear sight base 22. As illustrated, bottom 33 of notch lies above the rear sight base 22 and mount 31. In other implementations (not shown), the notch 29 may extend to the rear sight base 22 and mount 31 such that the notch 29 generally divides the rear sight 20. The notch 29 is open at rear sight top 21 and not annular in configuration.

Rear sight 20 may be formed of various metals such as steel, plastics, or other suitable materials, or combinations thereof. Face 23 of rear sight 20 may be generally dark in color and may have a generally matte or other non-reflective finish. The rear sight 20, in some implementations, may be formed of an opaque material so that the user 950 may look through only the notch 29 of the rear sight 20. In some implementations, the rear sight 20 may be formed, at least in part, of transparent material such as, for example, polycarbonate to allow the user 950 to view the target 980 through the rear sight 20. This may lessen the obscuration of the user's view of the target 980 by the rear sight 20.

Complementary image portions 25, 27 may be painted upon face 23 of rear sight 20 in various implementations. Complementary image portions 25, 27 may be formed of various clear plastics, colored plastics, ivory, bone, garnet, glass, or other materials suitable for this purpose mounted upon face 23 of rear sight 20, inlaid into face 23 of rear sight 20, or combinations thereof, in various implementations. As illustrated in FIG. 1B, complementary image portions 25, 27 are located proximate sides 35, 37, respectively, of notch 29 so that image portions 25, 27 may be aligned with image portions 45, 47, respectively, of front sight 40 to form unitary images 65, 67, respectively.

The front sight 40 of aiming apparatus 10 is illustrated in FIG. 1C. As illustrated in FIG. 1C, front sight 40 is generally configured as a post 50. From the viewpoint of user 950, face 43 of front sight 40 may have a generally rectangular shape bounded by sides 55, 57, front sight base 42, and front sight top 41, as illustrated. In other implementations, face 43 may be tapered such that face 43 is wider proximate front sight base 42 and tapers toward front sight top 41. Front sight top 41 is generally flat, as illustrated in FIG. 1C. The front sight base 42 may be mounted to slide 930, barrel 661 (FIG. 8), or other surface by mount 51. In various implementations, mount 51 may be formed as a dovetail, one or more screws may attach the mount, or the mount may be formed by sweat soldering or staking. In various implementations, the front sight 40 may be mounted in various other ways, or the mount may include various mechanisms that allow adjustment of the front sight 40, as would be recognized by those of ordinary skill in the art upon study of this disclosure. For example, a ramp may be included in the mount of the front sight 40 to allow for adjustment of the height of the front sight 40. In various implementations, face 43 may be generally vertical with respect to the surface to which the front sight 40 is mounted or may be canted such that face 43 slopes toward muzzle 913 such that face 43 is generally closer to muzzle 913 proximate front sight top 41 than proximate front sight base 42.

Front sight 40 may be formed of various metals, plastics, or other suitable materials, or combinations thereof. Face 43 of front sight 40 may be generally dark in color and may have a generally matte or other non-reflective finish. Image portions 45, 47 may be painted upon face 43 of front sight 40 in various implementations. Image portions 45, 47 may be formed of various clear plastics, colored plastics, ivory, bone, or other materials suitable for this purpose mounted upon face 43 of front sight 40, inlaid into face 43 of front sight 40, or combinations thereof, in various implementations.

Image portions 45, 47 of front sight 40 or complimentary image portions 25, 27 or rear sight 20 may be of various colors such as, without limitation, white, read, green, yellow, black, etc. Various combinations of colors may be used for the mage portions 45, 47 of front sight 40 or complimentary image portions 25, 27 or rear sight 20 in various implementations. The color(s) of the image portions 45, 47 of front sight 40 or complimentary image portions 25, 27 or rear sight 20 may be selected so as to be readily apprehended by the human eye to facilitate alignment of image portions 45, 47 with complementary image portions 25 27 to form unitary images 65, 67, respectively, and hence, alignment of front sight 40 and rear sight 20. The remainder of the face 43 of front sight 40 (i.e. the portion of face 43 excluding the image portions 45, 47) may be colored, textured, or so forth in order to enhance the visibility of image portions 45, 47. Similarly, the remainder of the face 23 of rear sight 20 (i.e. the portion of face 23 excluding the complementary image portions 25, 27) may be colored, textured, or so forth in order to enhance the visibility of complementary image portions 25, 27.

Image portions 45, 47 of front sight 40 or complimentary image portions 25, 27 or rear sight 20 may include various luminescent materials such as tritium, radium phosphors, photo-luminescent materials, and other such materials or combinations of materials to illuminate the image portions 45, 47 or complimentary image portions 25,27 under low light conditions in various implementations. In various implementations, image portions 45, 47 or complimentary image portions 25, 27 may include fiber-optic elements configured to gather light in order to illuminate the image portions 45, 47 or complimentary image portions 25,27 particularly under low light conditions.

In other implementations of the aiming apparatus (not shown), the rear sight may be configured as a post and the front sight may be configured to have a notch, i.e. a reversal of the implementation illustrated in FIGS. 1A, 1B, and 1C. The use would then align the rear post with the front notch. Image(s) and complementary image(s) would be provided accordingly to assist the user in aligning the front sight and rear sight as generally disclosed herein.

Figure 2:
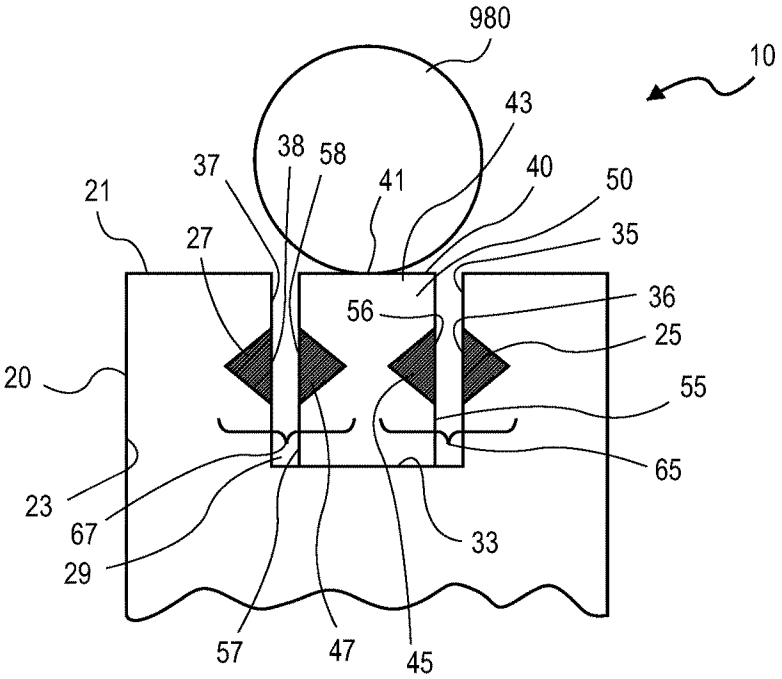
FIG. 2 illustrates by frontal view portions of the exemplary implementation of the aiming apparatus of FIG. 1A including the sight picture of the rear sight and front sight aligned with one another and aligned with the target as seen along the line of sight.

FIG. 2 illustrates aiming apparatus 10 with the rear sight 20 aligned with the front sight 40 and target 980 in an exemplary sight picture as viewed by user 950 along line of sight 975. As illustrated in FIG. 2, portions of face 43 of front sight 40 are positioned within slot 29 of rear sight 20 such that front sight top 41 is aligned with rear sight top 21. Front sight 40 is positioned such that the opening between side 57 of front sight 40 and side 37 of rear sight 20 appears to be substantially equal to the opening between side 55 of front sight 40 and side 35 of rear sight 20 in this implementation. The front sight top 41 of front sight 40 may be positioned at a six o'clock position of target 980, which is circular, in this illustration, and the front sight 40 and rear sight 20 may be set with respect to firearm 911 to strike the center of target 980 when firearm 911 is fired with this sight picture.

As illustrated in FIG. 2, image portion 45 of front sight 40 generally merges with complementary image portion 25 of rear sight 20 to form a unitary image 65, and image portion 47 of front sight 40 generally merges with complementary image portion 27 of rear sight 20 to form a unitary image 67 when front sight 40 and rear sight 20 are aligned with one another. Thus, the user 950 may align image portion 45 of front sight 40 with complementary image portion 25 of rear sight 20 and image portion 47 of front sight 40 with complementary image portion 27 of rear sight 20 to form unitary images 65, 67, respectively in order to align front sight 40 and rear sight 20 with one another.

As illustrated in FIG. 2, complementary image portions 25, 27 define edges 36, 38, respectively. Edges 36, 38 are generally co-extensive with sides 35, 37, respectively of notch 29 in this implementation. Image portions 45, 47 define edges 56, 58, respectively, and edges 56, 58 are generally co-extensive with sides 55, 57 of face 43 of front sight 40 in this implementation. Accordingly, edge 36 of complementary image portion 25 may generally align with edge 56 of image portion 45 to form unitary image 65 and edge 38 of complementary image portion 27 may generally align with edge 58 of image portion 47 to form unitary image 67. In some implementations, there may be a gap between edge 36 and edge 56 in unitary image 65 and a gap between edge 38 and edge 58 in unitary image 67, as illustrated in FIG. 2. In other implementations (see FIG. 3) the edge(s) of the image portion(s) may appear to be generally abutting the edge(s) of the complementary image portion(s).

As used herein, a unitary image may be of recognizable configuration to the user. In various aspects, a unitary image is an image that is geometric in nature. For example, unitary images 65, 67 have a diamond shape in the implementation illustrated in FIG. 2. A unitary image may have other geometric shapes in other implementations such as, for example, rectangular shape, square shape, oval shape, single diamond, triangular, or star shaped, as illustrated in FIGS. 3, 4, 5, 6, 7, & 8. The unitary image is a meaningful image having a recognizable shape differentiable, for example, from the mere alignment of dots, the alignment of one line with another, or the alignment of bars.

Figure 3:
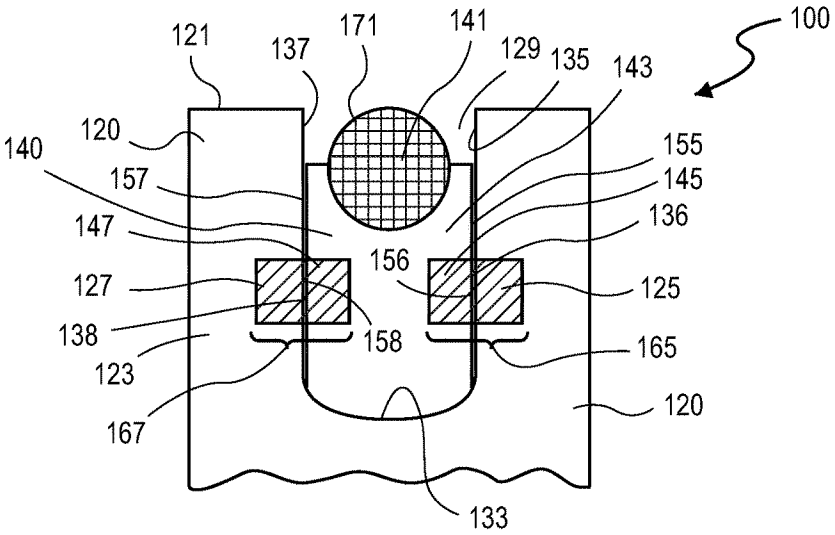
FIG. 3 illustrates by frontal view portions of another exemplary implementation of an aiming apparatus including the sight picture of the rear sight and front sight aligned with one another as seen along a line of sight parallel to a barrel of a firearm.

As illustrated in FIG. 3, aiming apparatus 100 includes front sight 140 and rear sight 120 in alignment with one another along the user's line of sight. Font sight 140 is generally configured as a post having face 143 with bead 171 mounted upon end 141 thereof. Face 143 of front sight 140 is bounded by sides 155, 157. Rear sight 120, as illustrated in FIG. 3, defines notch 129 in rear sight top 121. Notch 129 extends into rear sight 120 from rear sight top 121 and notch 129 passes between face 123 and the opposing face of rear sight 120 so that a user may look through sight 120 through notch 129. Notch 129 has a "U" shaped configuration with rounded bottom 133 and generally vertical sides 135, 137.

With front sight 140 aligned with rear sight 120, the outer circumference of bead 171 is aligned with rear sight top 121, as illustrated. Image portions 145, 147 on face 143 of front sight 140 align with complementary image portions 125, 127 on face 123 of rear sight 120 to form unitary images 165, 167, respectively. Unitary images 165, 167, in this implementation, are configured as rectangles.

In the implementation of FIG. 3, the front sight 140 and notch 129 of rear sight 120 are sized such that sides 135, 137 of notch 129 of rear sight 120 generally align with sides 155, 157 of face 143 of front sight 140. Thus, in this implementation, there is essentially no gap between edge 136 of complementary image portion 125 and edge 156 of image portion 145 in unitary image 165, and essentially no gap between edge 138 of complementary image portion 127 and edge 158 of image portion 147 in unitary image 167. In other implementations, edge of complementary image portion, such as edge 136 of complementary image portion 125, may overlap with edge of image portion such as, edge 156 of image portion 145. In still other implementations, there may be a gap between the edge of the complementary image portion and the edge of the image portion. In various implementations, the edge of the image portion or the edge of the complementary image portion may be straight, as illustrated in FIG. 3, may be curved, or may have other shape.

FIG. 4 illustrates another implementation of aiming apparatus 200 as seen along the user's line of sight. As illustrated, front sight 240 is generally configured as a post with front sight top 241 that is generally flat. Rectangular notch 229 is defined in rear sight 220 and notch 229 extends into rear sight 220 from rear sight top 221. With front sight 240 aligned with rear sight 220 in notch 229, the front sight top 241 is aligned with rear sight top 221, as illustrated. Image portions 245, 247 on face 243 of front sight 240 align with complementary image portions 225, 227 on face 223 of rear sight 220 to form unitary images 265, 267, respectively. Unitary images 265, 267, in this implementation, are configured as circles.

Another implementation of aiming apparatus 300 as seen along the user's line of sight is illustrated in FIG. 5. As illustrated in FIG. 5, front sight 340 is generally configured as a post with front sight top 341 that is generally flat. Rectangular notch 329 is defined in rear sight 320 and notch 329 extends into rear sight 320 from rear sight top 321. With front sight 340 aligned with rear sight 320, the front sight top 341 is aligned with rear sight top 321, as illustrated. Image portion 345 on face 343 of front sight 340 aligns with complementary image portions 325, 327 on face 323 of rear sight 320 to form unitary image 365. Unitary image 365, in this implementation, is configured as an oval (racetrack) shape. Unitary image 365, in this implementation, encompasses portions of face 323 of rear sight on both sides of notch 329 as well as portions of face 343 of front sight 340.

Another implementation of aiming apparatus 400 as seen along the user's line of sight is illustrated in FIG. 6. As illustrated in FIG. 6, front sight 440 is generally configured as a post with front sight top 441 that is generally flat. Rectangular notch 429 is defined in rear sight 420 and notch 429 extends into rear sight 420 from rear sight top 421. With front sight 440 aligned with rear sight 420, the front sight top 441 is aligned with rear sight top 421, as illustrated. Image portion 445 on face 443 of front sight 440 aligns with complementary image portions 425, 427 on face 423 of rear sight 420 to form unitary image 465. Unitary image 465, in this implementation, is configured as diamond shape that encompasses portions of face 423 of rear sight on both sides of notch 429 as well as portions of face 443 of front sight 440.

As illustrated in FIG. 7, aiming apparatus 500 includes front sight 540 and rear sight 520. Font sight 520 is generally configured as a post with front sight top 541 that is generally peaked to end in a point 577. Rear sight 520, as illustrated in FIG. 7, defines notch 529 in rear sight top 521. Notch 529 has a "V" shaped configuration with pointed bottom 533 and generally sloped sides 535, 537. Portions of face 523 of rear sight 520 obscure portions of face 543 of front sight 540 as seen along the user's line of sight in this implementation. Thus, in this implementation, the image portions 545, 547 may be formed within the interior of face 543 and may not extend to edges 555, 557, respectively of face 543. A number of complementary image portion(s) may be disposed along the "V" of rear sight 520 and corresponding image portion (s) disposed along the length of face 543 so that the user may selectively align one of the image portion(s) with the corresponding complementary image portion(s) to select an elevation in order to compensate for bullet drop. The elevation selected may depend upon the distance to the target.

As illustrated in FIG. 7, the point 577 of front sight top 541 is aligned with rear sight top 521 when rear sight 520 and front sight 540 are aligned with one another as seen along the user's line of sight. Image portions 545, 547 on face 543 of front sight 540 align with complementary image portions 525, 527 on face 523 of rear sight 520 to form unitary images 565, 567, respectively. Unitary images 565, 567, in this implementation, are configured as rectangles.

As illustrated in FIG. 8, aiming apparatus 800 includes front sight 840 and rear sight 820 in alignment with one another along the user's line of sight. In this implementation, rear sight 820 is formed of a transparent material so that the user may view the front sight 840 through the rear sight 820. In this implementation, the user's line of sight passes through the transparent material portion of the rear sight 820. The transparent material may be configured to be generally flat so as not to magnify front sight 840 or otherwise alter the user's natural vision, in some implementations. Rear sight 820, as illustrated in FIG. 8, includes complementary image portions 825, 827. Complementary image portions 825, 827 may be formed about surface 823 of rear sigh, which faces the user, in some implementations. In other implementations, complementary image portions 825, 827 may be formed about surface 833 of rear sight 820, which is generally oriented toward the front sight 840, or complementary imager portions 825, 827 may be formed, at least in part, within the transparent material of the rear sight 820 between surface 823 and surface 833. Complementary image portions 825, 827 have sides 836, 838, respectively, and sides 836, 838 are oriented vertically in this implementation. Complementary image portions 825, 827 may be formed on or about the transparent material that forms a portion of the rear sight 820 so that the complementary image portions 825, 827 lie within the user's line of sight when the user views the front sight through the transparent portions of the rear sight.

Front sight 840 includes face 843, front sight top 841, and image portion 845. Image portion 845 has sides 856, 858 that generally match sides 855, 857 of front sight 840, respectively. Front sight 840 and associated features are shown in phantom in FIG. 8 to indicate that front sight 840 is viewed through transparent rear sight 820 along the line of sight in this implementation.

With front sight 840 aligned with rear sight 820 along the user's line of sight, the image portion 845 on face 843 of front sight 840 align with complementary image portions 825, 827 on face 823 of rear sight 820 to form unitary image 865. Unitary image 865, in this implementation, is configured as a star.

In the implementation of FIG. 8, with the front sight 840 and rear sight 820 in alignment with one another, vertical sides 836, 838 of complementary image portions 825, 827 align with sides 856,858 of image portion 845, and sides 855, 857 of front sight 840 generally align with sides 836, 838 of complementary image portions 825, 827. In other implementations having a transparent rear sight such as rear sight 820, the image portion(s), such as 845, and complementary image portion(s), such as 825, 827, may be disposed about the front sight, such as front sight 840, and the rear sight in various ways to align with one another to form unitary image(s). The complementary images may or may not align with the sides, such as sides 855, 857 of the front sight in various implementations. The image portions, the complementary image portions, or both may be illuminated by, for example, light emitting diode, or the use of various luminescent materials in various implementations in which portions of the rear sight are transparent.

Figure 9:
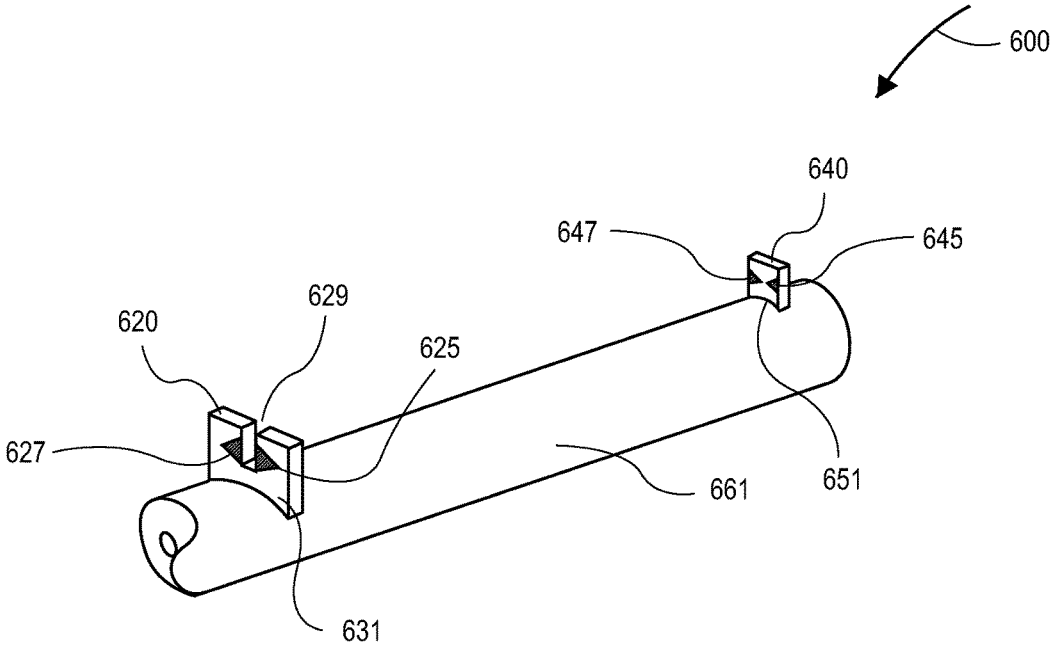
FIG. 9 illustrates by perspective view an exemplary implementation of an aiming apparatus disposed upon a barrel of a firearm.

FIG. 9 illustrates an implementation of aiming apparatus 600 mounted to barrel 661. In various implementations, barrel 661 may be the barrel of a rifle, pistol, or other firearm. As illustrated in FIG. 8, front sight 640 is mounted to barrel 661 by mount 651. Front sight 640 includes image portion 645 in this implementation. Rear sight 620 is mounted to barrel 661 by mount 631, as illustrated in FIG. 9. Rear sight 620 defines notch 629 and includes complementary image portions 625, 627. In other implementations, the rear sight, such as rear sight 620, may be mounted to a slide, receiver, or other part of the firearm, and the front sight, such as front sight 640 mounted to barrel 661. The front and rear sights may be mounted about the firearm in other ways or combinations of ways as would be recognized by those of ordinary skill in the art upon study of this disclosure.

Figure 10:
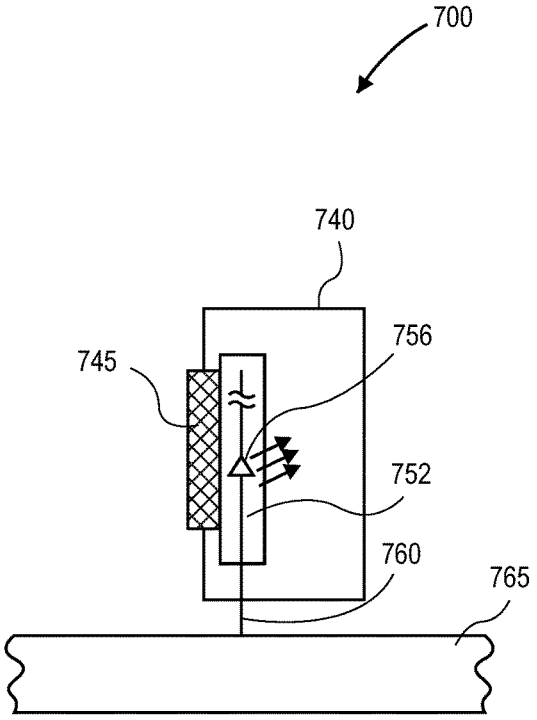
FIG. 10 illustrates by cut-away side view portions of an exemplary implementation of a sight including a lens illuminated by an LED.

FIG. 10 illustrates a portion of an implementation of a portion of a sight 740 of an aiming apparatus 700. Sight 740 may be a front sight, such as front sight 40, 140, 240, 340, 440, 540, 640, 840 or sight 740 may be a rear sight, such as rear sight 20, 120, 220, 320, 420, 520, 620, 820. In this implementation, sight 740 includes lens 745 that may be formed of various transparent or translucent material such as glass or plastic. Lens 745 may form at least a portion of an image portion, such as image portion 45, 47, 145, 147, 245, 247, 345, 445, 545, 547, 645, 845 or lens 745 may form at least a portion of a complementary image portion, such as complementary image portion 25, 27, 125, 127, 225, 227, 325, 327, 425, 427, 525, 527, 625, 627, 825, 827. The lens 745 may be generally clear in some implementations, or the lens 745 may be of a single color in other implementations, or the lens 745 may be of multiple colors in other implementations. As illustrated in FIG. 10, lens 745 in combination with other portions of sight 740 define cavity 752.

As illustrated in FIG. 10, LED 756 within cavity 752 emits light that passes through lens 745 to illuminate lens 745 thereby illuminating the image portion or complementary image portion that includes lens 745. LED 756 may emit white light or may emit light having various colors and lens 745 may be clear or may be colored. LED 756 is in electrical communication with rail 765 by path 760 to flow electrical current onto LED 756 from rail 765 in this implementation. Electrical current may be communicated onto LED 756 in other ways in other implementations. Sight 740 may be mounted to rail 765. Rail 765, in turn, may be mounted about a firearm such as firearm 911 (FIG. 1A), and rail 765 may be in communication with a power source such as a battery (not shown).

Figure 12:
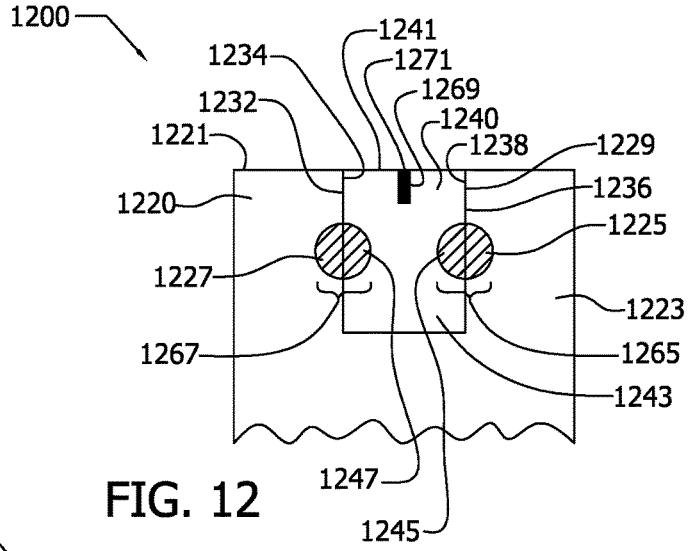
FIG. 12 illustrates by frontal view portions of an exemplary implementation of an aiming apparatus including the sight picture of the rear sight and front sight aligned with one another as seen along a line of sight parallel to a barrel of a firearm.

FIG. 12 illustrates another implementation of aiming apparatus 1200 as seen along the user's line of sight. As illustrated, front sight 1240 is generally configured as a post with front sight top 1241 that is generally flat and edges 1234, 1238, as illustrated. Front sight top 1241 may have other shapes in other implementations. Rectangular notch 1229 is defined in rear sight 1220 and notch 1229 extends into rear sight 1220 from rear sight top 1221 with notch edges 1232, 1236, as illustrated.

With front sight 1240 aligned with rear sight 1220 in notch 1229, the front sight top 1241 is aligned visually with rear sight top 1221, as illustrated, and edges 1234, 1238 are visually placed against notch edges 1232, 1236, respectively. Image portions 1245, 1247 on face 1243 of front sight 1240 align with complementary image portions 1225, 1227 on face 1223 of rear sight 1220 to form unitary images 1265, 1267, respectively. Unitary images 1265, 1267, in this implementation, are configured as circles.

Mark 1269 on face 1243 of front sight 1240 is located along front sight top 1241 at midpoint 1271, which is midway between edges 1234, 1238, and, thus, mark 1269 indicates visually the midpoint 1271 of front sight top 1241. Mark 1269, which is illustrated as a line in this implementation, may be of size, length from front sight top 1241, other proportions, and color to attract the user's vision in preference to portions of face 1243 of front sight 1240 other than image portions 1245, 1247 and in preference to portions of face 1223 of rear sight 1220 other than complementary image portions 1225, 1227. In this implementation, mark 1269 extends from front sight top 1241 at a right angle with respect to front sight top 1241. Mark 1269 may be formed of luminescent material to glow in the dark or mark 1269 may be illuminated, for example by an LED, such as LED 756, in various implementations.

The mark 1269 along with unitary images 1265, 1267 may remove the need for visual estimating of relationships between the front sight 1240 and the rear sight 1229 by the user during alignment of the front sight 1240 with the rear sight 1229 and with a target, such as target 980. Unitary images 1265, 1267 may indicate alignment of front sight 1240 with rear sight 1229 without estimating relationships between front sight 1240 and rear sight 1229. With front sight 1240 visually aligned with rear sight 1229, mark 1269 may be used to position visually midpoint 1271 of front sight 1240 with respect to a target without requiring estimation of midpoint 1271 of front sight 1240.

Figure 13:
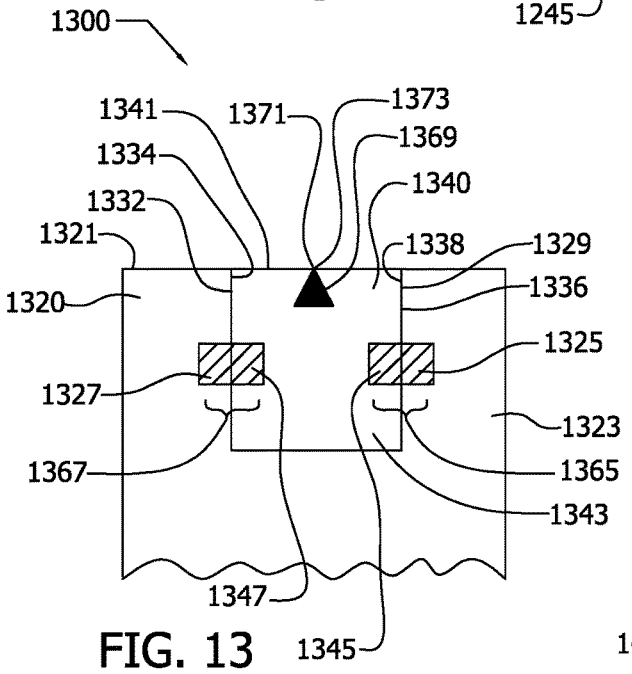
FIG. 13 illustrates by frontal view portions of an exemplary implementation of an aiming apparatus including the sight picture of the rear sight and front sight aligned with one another as seen along a line of sight parallel to a barrel of a firearm.

FIG. 13 illustrates another implementation of aiming apparatus 1300 as seen along the user's line of sight. As illustrated, front sight 1340 is generally configured as a post with front sight top 1341 that is generally flat and edges 1334, 1338, as illustrated. Rectangular notch 1329 is defined in rear sight 1320 and notch 1329 extends into rear sight 1320 from rear sight top 1321 with notch edges 1332, 1336, as illustrated.

With front sight 1340 aligned with rear sight 1320 in notch 1329, the front sight top 1341 is aligned visually with rear sight top 1321, as illustrated, and edges 1334, 1338 are visually placed against notch edges 1332, 1336, respectively. Image portions 1345, 1347 on face 1343 of front sight 1340 align with complementary image portions 1325, 1327 on face 1323 of rear sight 1320 to form unitary images 1365, 1367, respectively, indicative of sight alignment. Unitary images 1365, 1367, in this implementation, are configured as rectangles.

Mark 1369 on face 1343 of front sight 1340 is formed as a triangle, in this implementation, with apex 1373 visually designating midpoint 1371 of front sight top 1341, which is midway between edges 1334, 1338. Mark 1369 may be of size, shape, and other proportions and color(s) to attract the user's vision in preference to portions of face 1343 of front sight 1340 other than image portions 1345, 1347 and in preference to portions of face 1323 of rear sight 1320 other than complementary image portions 1325, 1327.

Figure 14:
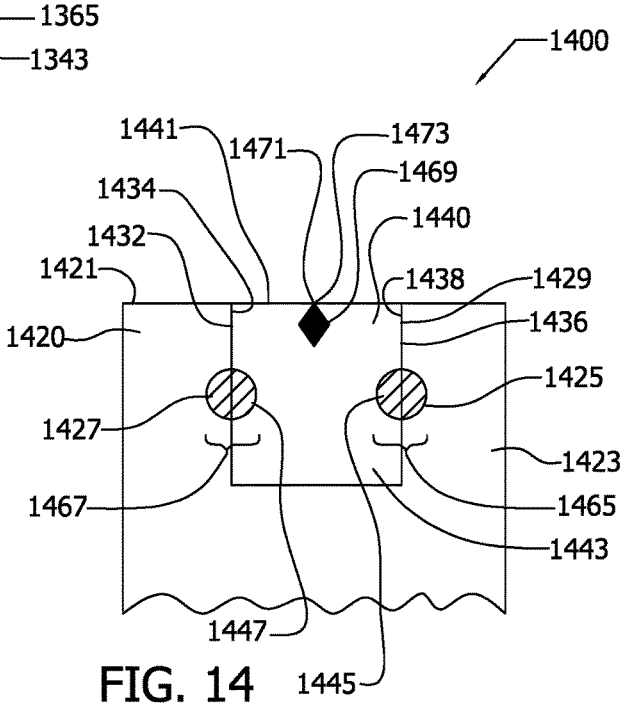
FIG. 14 illustrates by frontal view portions of an exemplary implementation of an aiming apparatus including the sight picture of the rear sight and front sight aligned with one another as seen along a line of sight parallel to a barrel of a firearm.

FIG. 14 illustrates another implementation of aiming apparatus 1400 as seen along the user's line of sight. As illustrated, front sight 1440 is generally configured as a post with front sight top 1441 that is generally flat and edges 1434, 1438, as illustrated. Rectangular notch 1429 is defined in rear sight 1420 and notch 1429 extends into rear sight 1420 from rear sight top 1421 with notch edges 1432, 1436, as illustrated.

With front sight 1440 aligned with rear sight 1420 in notch 1429, the front sight top 1441 is aligned visually with rear sight top 1421, as illustrated, and edges 1434, 1438 are visually placed against notch edges 1432, 1436, respectively. Image portions 1445, 1447 on face 1443 of front sight 1440 align with complementary image portions 1425, 1427 on face 1423 of rear sight 1420 to form unitary images 1465, 1467, respectively, indicative of sight alignment. Unitary images 1465, 1467, in this implementation, are configured as rectangles.

Mark 1469 on face 1443 of front sight 1440 is formed as a diamond (rhombus), in this implementation, with apex 1473 visually designating midpoint 1471 of front sight top 1441, which is midway between edges 1434, 1438. Mark 1469 may be of size, shape, and other proportions and color(s) to attract the user's vision in preference to portions of face 1443 of front sight 1440 other than image portions 1445, 1447 and in preference to portions of face 1423 of rear sight 1420 other than complementary image portions 1425, 1427. The mark, such as mark 1269, 1369, 1469, may have other geometric shapes or otherwise indicate the midpoint, such as midpoint 1271, 1371, 1471, in other implementations.

In operation, a user, such as user 950, may aim a firearm, such as firearm 911, at a target such as target 980 by viewing a front sight, such as front sight 40, 140, 240, 340, 440, 540, 640, 1240, 1340, 1440 generally configured as a post through a notch, such as notch 29, 129, 229, 329, 429, 529, 629, 1229, 1329, 1429 of a rear sight, such as rear sight 20, 120, 220, 320, 420, 520, 620, 1220, 1320, 1420. In some implementations, the user may view the front sight, such as front sight 840, through the rear sight, such as rear sight 820 through transparent material included in the rear sight. The front sight may include one or more image portions such as image portions 45, 47, 145, 147, 245, 247, 345, 445, 545, 547, 645, 647, 845, 1245, 1247, 1345, 1347, 1445, 1447. The rear sight may include one or more complementary image portions, such as complementary image portions 25, 27, 125, 127, 225, 227, 325, 327, 425, 427, 525, 527, 625, 627, 825, 827, 1225, 1227, 1325, 1327, 1425, 1427. The user may align the front sight with the rear sight by aligning the image portion(s) with the complementary image portion(s) to form one or more unitary images, such as unitary image 65, 67, 165, 167, 265, 267, 365, 465, 565, 567, 865, 1265, 1267, 1365, 1367, 1465, 1467 from the viewpoint of the user, for example, along the barrel, such as barrel 661. By aligning the front sight with the rear sight, an image portion formed on the front sight combines with a complementary image portion formed on the rear sight thereby presenting a unitary image to the user. The user may align the front sight and the rear sight with the target. With the front sight and the rear sight aligned with one another and with the target, the user may engage the target by firing the firearm at the target. The user may align the front sight and rear sight with the target by positioning a portion of the front sight, such as front sight top 41, 241, 341, 441, 541, 841, 1241, 1341, 1441, or bead 171 with respect to the target. The user may align the front sight and rear sight with the target by positioning the unitary image with respect to the target. For example, the center of unitary image 865 may be centered on the target to align the front sight 840 and rear sight 820 with the target. The user may align the front sight and rear sight with the target by centering visually a midpoint, such as midpoint 1271, 1371, 1471 of the front sight top of the front sight, as indicated by a mark, such as mark 1269, 1369, 1469, with respect to the target. When so centered, the midpoint may designate the location on the target to be hit, in this implementation. The user may select the target to be engaged from one or more targets. The user may engage multiple targets and may do so in succession.

The unitary images may indicate alignment of front sight with the rear sight without estimating relationships such as gaps or vertical alignment between front sight and rear sight. With the front sight visually aligned with rear sight, the mark may be used to align visually the midpoint of the front sight top of the front sight with the target without requiring estimation of the location of the midpoint of the front sight top. Thus, the mark along with the images and complimentary images may eliminate the need for visual estimating in aligning the rear sight with the front sight and with the target.

Figure 11:
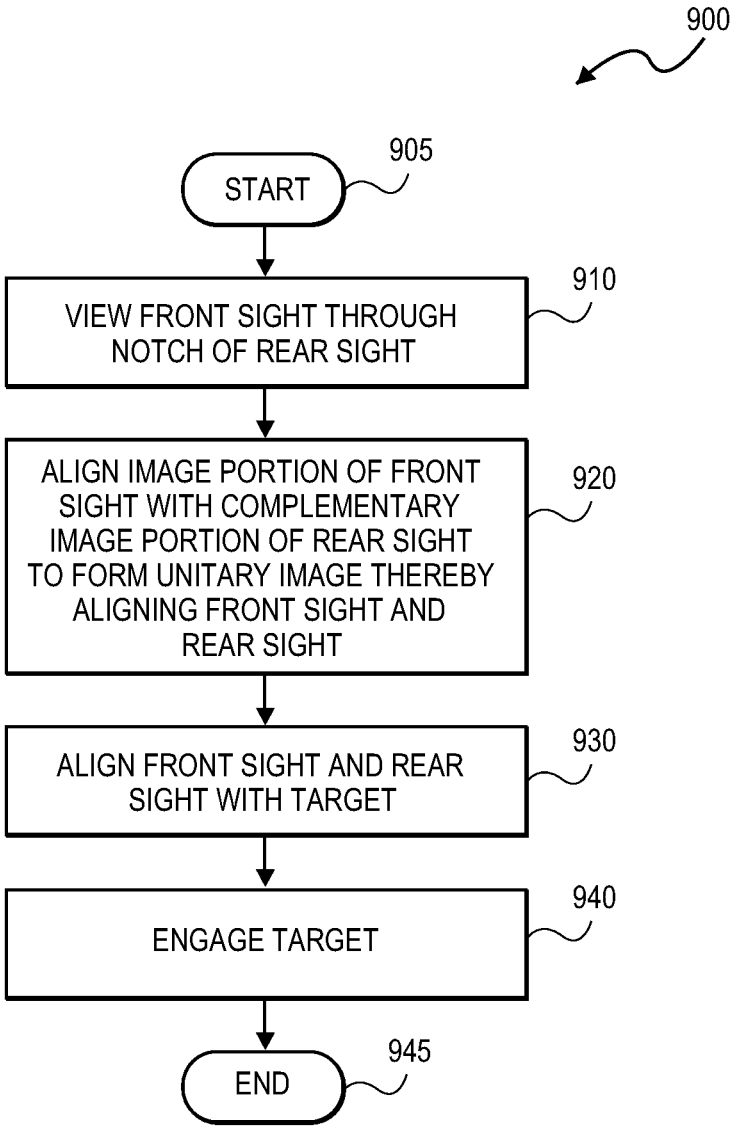
FIG. 11 illustrates by process flow chart an exemplary method of operation of an exemplary aiming apparatus.

These operations are generally illustrated by operational method 900, as illustrated by process flow chart in FIG. 11. As illustrated in FIG. 11, operational method 900 is entered at step 905. The user may then orient the firearm such that the user views the front sight along a line of sight extending through the notch of the rear sight, at step 910. At step 920, the user aligns the image portion(s) of the front sight with the complementary image portion(s) of the rear sight to form one or more unitary images. At step 930, the user aligns the front and rear sights with the target so that the rear sight, front sight, and target are in alignment with one another along the user's line of sight, such as line of sight 975. At step 940, the user engages the target, for example, by firing one or more bullets at the target. Operational method 900 is exited at step 945.

In some implementations, the aiming apparatus may be attached to a firearm or other device that the user may manipulate by hand to align the front sight and rear sight with one another and with the target. In other implementation, the user may manipulate the device to which the aiming apparatus is attached mechanically through the manipulation of gears, hydraulic actuators, solenoids, or so forth, and associated controls to align the front sight and the rear sight with one another and with the target.

In various implementations, the user may initiate the flow of electrical current onto one or more LED's, such as LED 756, to illuminate the image portion, the complementary image portion, or both, or may turn off the flow of electrical current onto one or more LED's. The various operations of the aiming apparatus may include illuminating the image portion, the complementary image portion, or the mark, by using luminescent materials. In some implementations, the user may view the target, regions proximate the target, or both by looking through portions of the rear sight wherein these portions of the rear sight are formed of a transparent material. In such implementations, the complementary image portions may be formed upon the transparent material.

The foregoing discussion along with the Figures discloses and describes various exemplary implementations. These implementations are not meant to limit the scope of coverage, but, instead, to assist in understanding the context of the language used in this specification and in the claims. Upon study of this disclosure and the exemplary implementations herein, one of ordinary skill in the art may readily recognize that various changes, modifications and variations can be made thereto without departing from the spirit and scope of the inventions as defined in the following claims.

What is claimed is:

1. An apparatus, comprising:

a front sight with a straight edge and a front sight top;

a rear sight with a straight edge;

an image formed on a portion of a face of the front sight, the image defining a portion of the edge and of finite length, the image consisting of an image color that highlights the image including the edge portion in contrast with a remainder of the face to attract a user's vision to the edge portion in preference to the remainder of the face;

a complementary image formed on a portion of a rear face of the rear sight, the complementary image consisting of a complementary image color that highlights the complementary image including a complementary edge portion in contrast with a remainder of the rear face to attract the user's vision to the complementary edge portion in preference to the remainder of the rear face;

a unitary image formed when the front sight is viewed through the rear sight along a line of sight parallel to a barrel and the front sight is aligned with the rear sight by visual placement of an entirety of the complementary edge portion against an entirety of the edge portion, the unitary image highlighted to attract the user's vision in preference to the remainder of the face and the remainder of the rear face; and a mark formed on the face of the front sight to visually indicate a midpoint of the front sight top when viewed along the line of sight.

2. The apparatus of claim 1, the mark comprises a line.

3. The apparatus of claim 1, the mark comprises a triangle with an apex of the triangle indicative of the midpoint of the front sight top.

4. The apparatus of claim 1, the mark comprises a diamond with an apex of the diamond indicative of the midpoint of the front sight top.

5. The apparatus of claim 1, wherein the midpoint is aligned visually with the target to select a point of impact on the target.

6. An apparatus, comprising:

a front sight with a straight edge and an image consisting of an image color formed on a portion of a face of the front sight, the image defining a portion of the edge, the image color attracts a user's vision to the edge portion in preference to a remainder of the face;

a mark formed on the face of the front sight to visually indicate a midpoint of a front sight top of the front sight;

a rear sight with a straight edge and a complementary image consisting of a complementary image color formed on a portion of a rear face of the rear sight, the complementary image defining a complementary portion of the edge, the complementary image color attracts a user's vision to the complementary edge portion in preference to a remainder of the face;

a unitary image of recognizable geometric shape formed by visual abutment of the edge portion of the image against the complementary edge portion of the complementary image along a finite length while the front sight is viewed through the rear sight along a line of sight parallel to a barrel and the front sight is in alignment with the rear sight.

7. An apparatus, comprising:

a front sight with a straight edge and an image comprising an image color formed on a portion of a face of the front sight, the image defining a portion of the edge, the image color attract a user's vision to the edge portion in preference to a remainder of the face;

a rear sight with a straight edge and a complementary image comprising a complementary image color formed on a portion of a rear face of the rear sight, the complementary image defining a complementary portion of the edge, the complementary image color attracts a user's vision to the complementary edge portion in preference to a remainder of the face;

a unitary image formed by visual abutment of the edge portion of the image against the complementary edge portion of the complementary image along a finite length while the front sight is viewed through the rear sight along a line of sight parallel to a barrel and the front sight is in alignment with the rear sight.

8. The apparatus of claim 7 further comprising:

a mark formed on the face of the front sight to visually indicate a midpoint of a front sight top of the front sight.

9. The apparatus of claim 8 the mark comprises a geometric shape selected from a triangle and a diamond.

* * * * *